US008418307B1

(12) United States Patent
Rhee

(10) Patent No.: US 8,418,307 B1
(45) Date of Patent: Apr. 16, 2013

(54) DEVICE AND METHOD FOR CLEANING A NON-STICK COOKING SURFACE

(76) Inventor: Kyung Tai Rhee, Little Silver, NJ (US)

( * ) Notice: Subject to any disclaimer, the term of this patent is extended or adjusted under 35 U.S.C. 154(b) by 26 days.

(21) Appl. No.: 13/004,120

(22) Filed: Jan. 11, 2011

(51) Int. Cl.
*A47L 13/02* (2006.01)
*A47L 17/06* (2006.01)

(52) U.S. Cl.
USPC ..... 15/236.01; 15/236.07

(58) Field of Classification Search ..... 15/236.01, 15/236.02, 236.07, 236.08, 245.1
See application file for complete search history.

(56) References Cited

U.S. PATENT DOCUMENTS 2,347,963 A * 5/1944 O'Neill ..... 15/245
2,807,168 A * 9/1957 Wipf ..... 73/427
4,422,206 A * 12/1983 Brace et al. ..... 15/236.02
5,179,754 A * 1/1993 Stradnick ..... 15/105
5,806,134 A * 9/1998 Merrell ..... 15/236.02
6,895,672 B2 * 5/2005 Conforti ..... 30/169

* cited by examiner

*Primary Examiner* — Randall Chin
(74) *Attorney, Agent, or Firm* — LaMorte & Associates, P.C.

(57) ABSTRACT

A cleaning implement that is used to clean non-stick surfaces. The cleaning implement has a handle unit. A disposable plastic scrubber head is temporarily affixed to the handle unit. The plastic scrubber head has a base and a continuous flexible peripheral wall. The peripheral wall has a beveled top edge. Mechanical fasteners join the handle unit to the plastic scrubber. When a scrubber head is attached to the handle unit and is pressed against a non-stick surface, the peripheral wall deforms to the curvature of the non-stick surface. Simultaneously, the bevel top edge flattens toward the non-stick surface creating a scraper that can dislodge food material from the non-stick surface without scratching the non-stick surface. Once the scrubber head becomes worn, it is removed from the handle assembly and replaced.

17 Claims, 6 Drawing Sheets

DEVICE AND METHOD FOR CLEANING A NON-STICK COOKING SURFACE

BACKGROUND OF THE INVENTION

1. Field of the Invention

In general, the present invention relates to spatulas, brushes and other scrubbing utensils that are used to clean dishes, pots and pans. More particularly, the present invention relates to devices that are used to clean non-stick cooking surfaces that are coated with a fluoropolymer, such as Teflon®.

2. Prior Art Description

Many pots, pans, griddles and other cooking implements are coated with a non-stick material. Typically, the non-stick material is a fluoropolymer, such as polytetrafluoroethylene, which is known commercially as Teflon®.

Coating a cooking surface with a fluoropolymer makes the cooking surface very smooth. Accordingly, food does not stick to the surface and the cooking surface becomes very easy to clean. The one disadvantage of having a fluoropolymer cooking surface is that the fluoropolymer is essentially a thermoset plastic that is much softer than metal. Consequently, if the cooking surface is contacted by a metal utensil or part of another metal pot, scratches can easily occur in the fluoropolymer coating.

As the number of scratches increase in the fluoropolymer, the surface becomes less slick and more food begins to adhere to the surface during cooking. As a consequence, the cooking surface must be scrubbed a little harder when it is cleaned. This often results in more scratches in the fluoropolymer material. This scratch cycle continues until the fluoropolymer material is so scratched that the cooking surface must be replaced.

In an attempt to minimize scratching of non-stick surfaces, people often wash such surfaces using only a soft sponge and a non-abrasive cleanser. If food is firmly adhered to the non-stick cooking surface, then people commonly use a wooden spoon or a plastic spatula to scrape the food off the cooking surface. The problem is that wooden spoons and plastic spatulas cannot reach into the curves and corners of many types of pots, pans, waffle irons, and the like. Therefore, people are left with little option but to scrub such surfaces in a traditional manner, therein risking scratch damage to those surfaces.

A need therefore exists for a cleaning utensil that is specifically designed to clean cooking surfaces that are coated with a fluoropolymer, wherein the cooking utensil is softer than the fluoropolymer yet is stiff enough to scrape away residual food. A need also exists for a cleaning utensil that is shaped to remove food from curves and corners of pots and pans without scratching the fluoropolymer coating on those surfaces. These needs are met by the present invention as described and claimed below.

SUMMARY OF THE INVENTION

The present invention is a cleaning implement that is used to clean non-stick surfaces. The cleaning implement has a handle unit that is grasped and manipulate by a person cleaning a non-stick cooking surface. A disposable plastic scrubber head is temporarily affixed to the handle unit. The plastic scrubber head has a base and a continuous flexible peripheral wall that extends at least two centimeters from the periphery of the base. The peripheral wall has a beveled top edge.

A plurality of mechanical fasteners temporarily join the handle unit to the plastic scrubber in a manner that enables the scrubber head to be selectively removed and replaced when worn. When a scrubber head is attached to the handle unit and is pressed against a non-stick surface, the peripheral wall deforms to the curvature of the non-stick surface. Simultaneously, the bevel top edge flattens toward the non-stick surface creating a scraper that can dislodge food material from the non-stick surface without scratching the non-stick surface.

Once the scrubber head becomes worn, it is removed from the handle assembly and replaced. Since the scrubber head is molded from flexible plastic, the scrubber heads can be manufactured at very low cost.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention cleaning device can be embodied in many ways, a single embodiment is illustrated for the purpose of simplicity. The embodiment selected is one of the best modes contemplated for the invention. The illustrated embodiment, however, is merely exemplary and should not be considered a limitation when interpreting the scope of the appended claims.

Figure 1:
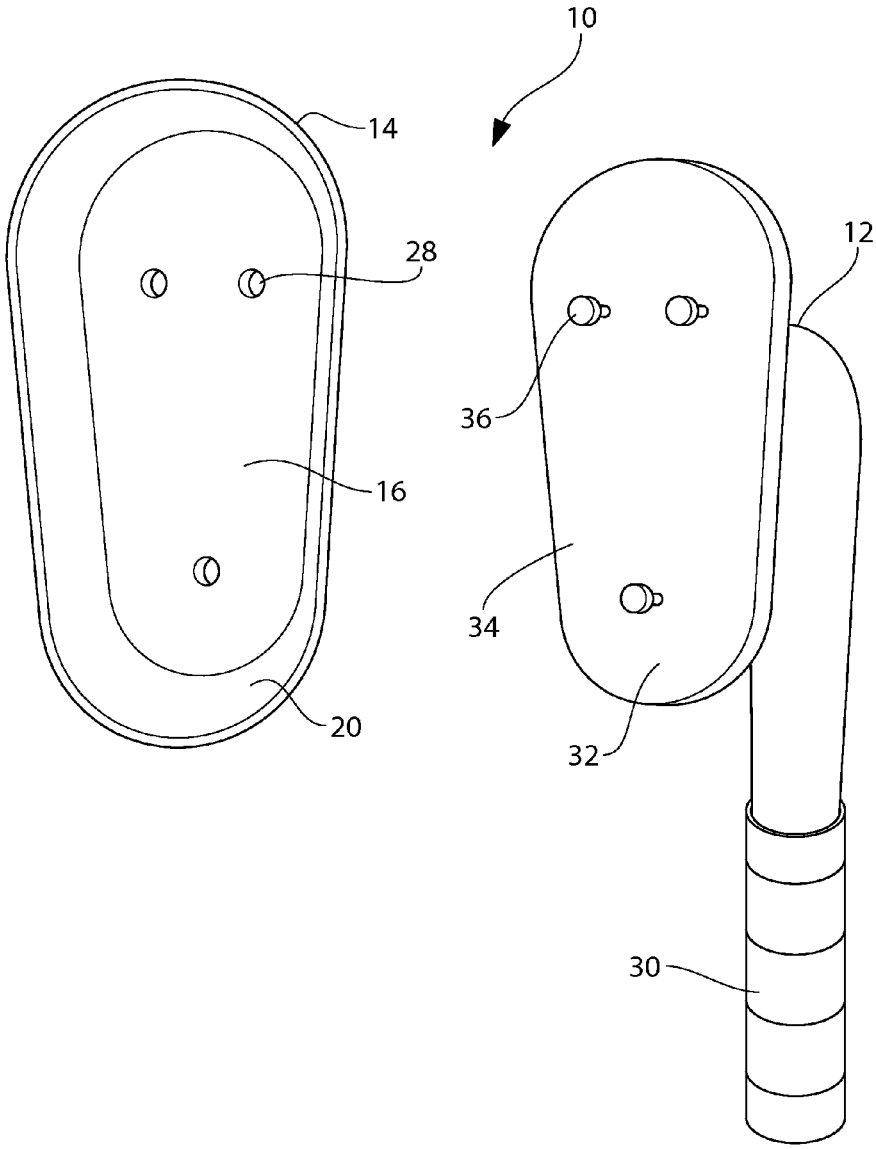
FIG. 1 is an exploded perspective view of an exemplary embodiment of the present invention cleaning device.
Figure 2:
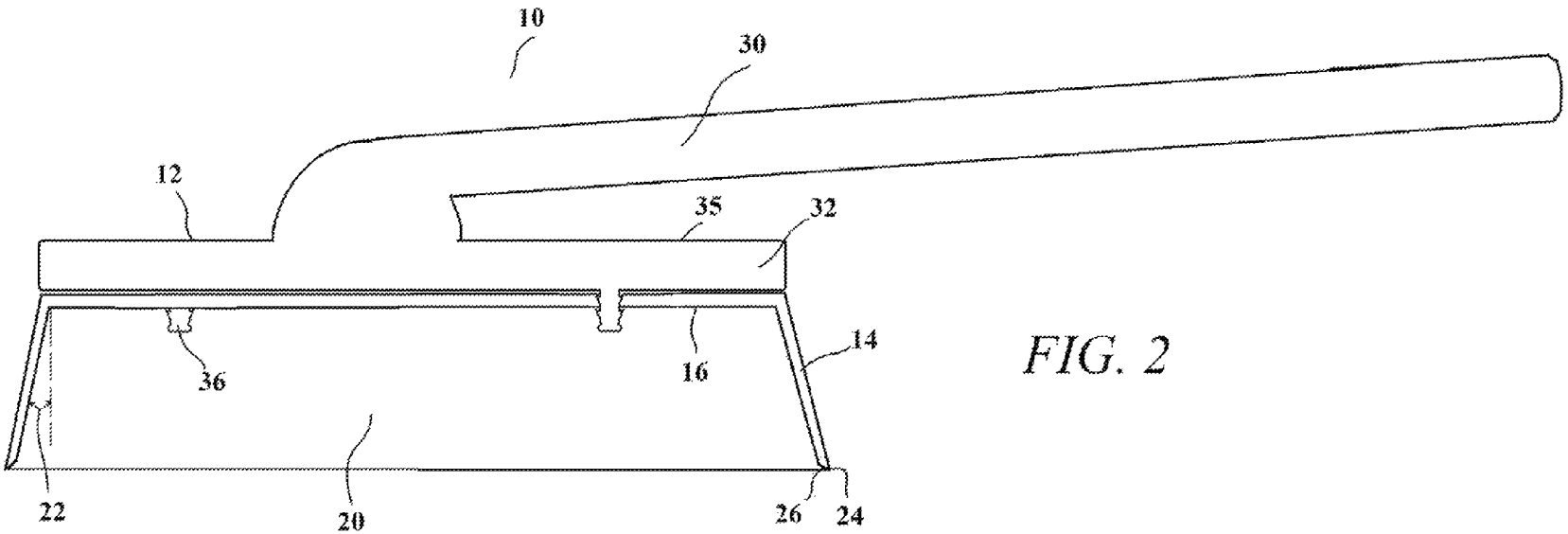
FIG. 2 is a cross-sectional view of the exemplary embodiment.

Referring to FIG. 1 in conjunction with FIG. 2, it can be seen that the cleaning device 10 is a handheld implement having a handle unit 12 and a detachable, disposable scrubber head 14. The scrubber head 14 is molded as a single piece of plastic. The plastic is soft and flexible, yet rigid enough to hold its own form when manipulated. Appropriate plastic would be polyethylene terephthalate, high-density polyethylene or polypropylene with an average wall thickness of under five millimeters. Such plastics are softer than polytetrafluoroethylene and other such fluoropolymers. Consequently, when the scrubber head is brought into contact with the harder non-stick cooking surface, the soft plastic material of the scrubber head 14 will not scratch the non-stick fluoropolymer coating.

The scrubber head 14 has a flat base 16. The base 16 has a peripheral edge that follows an oblong shape. A peripheral wall 20 extends away from the periphery of the base 16 at a diverging angle that is slightly greater than perpendicular. In this manner, the peripheral wall 20 angles away from the flat base 16 at a slight relief angle 22. The presence of the relief angle 22 enables multiple scrubber heads 14 to be stacked atop one another when packaged.

The peripheral wall 20 is continuous and defines an interior area. A locking groove 27 (shown in FIG. 5) 27 may be formed on the interior surface of the peripheral wall 20 that faces the interior area. The purpose of the locking groove 27 is later described.

Since the flat base 16 has an oblong shape, the peripheral wall 20 is continuous and propagates along an oblong path. The peripheral wall 20 therefore has no sharp edges or salient points. Rather, one end of the peripheral wall 20 follows a first radius of curvature R1, while the opposite side of the peripheral wall 20 follows a smaller second radius of curvature R2.

The peripheral wall 20 terminates with a top edge 24. The top edge 24 is beveled inwardly, thereby creating a beveled surface 26 that terminates at a point. The top edge 24 runs the entire length of the peripheral wall 20.

Mounting holes 28 are formed through the flat base 16 of the scrubber head 14. The mounting holes 28 are used to mount the scrubber head 14 to the handle unit 12, as will be later explained.

The handle unit 12 is part of the cleaning device 10 that is held and manipulated by a user. The handle unit 12 includes a handle 30 and a mounting plate 32. The mounting plate 32 has a flat outer surface 34 and a peripheral shape that is the same as, or smaller than, the flat base 16 of the scrubber head 14. The handle 30 extends away from the mounting plate 32 from the surface 35 opposite the outer surface 34.

Mechanical fasteners 36 extend out of the outer surface 34 of the mounting plate 32. The mechanical fasteners 36 are sized and positioned to engage the mounting holes 28 in the flat base 16 of the scrubber head 14. The mechanical fasteners 36 can have many forms, such as posts, clips, snaps, and hook and loop patches. What is necessary is that the mechanical fasteners 36 are capable of engaging the scrubber head 14 and holding the flat base 16 flush against the mounting plate 32 when the cleaning device 10 is in use. The mechanical fasteners 36 must also enable the scrubber head 14 to be removed and replaced with another as it becomes worn or soiled.

Figure 3:
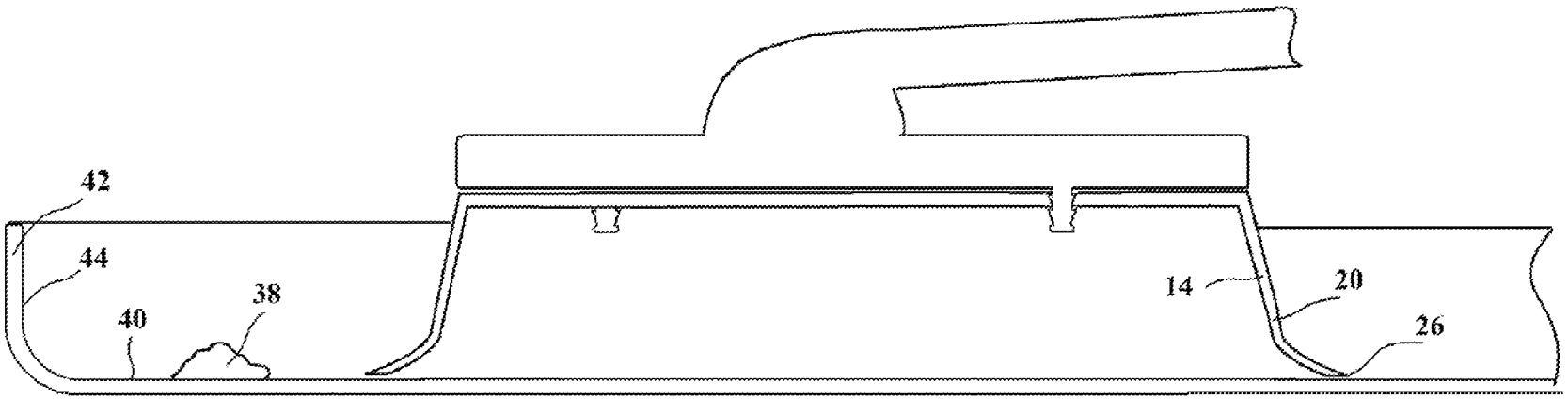
FIG. 3 is a fragmented view of the exemplary embodiment of a cleaning device engaging the base of a cooking pan coated with a non-stick surface.
Figure 4:
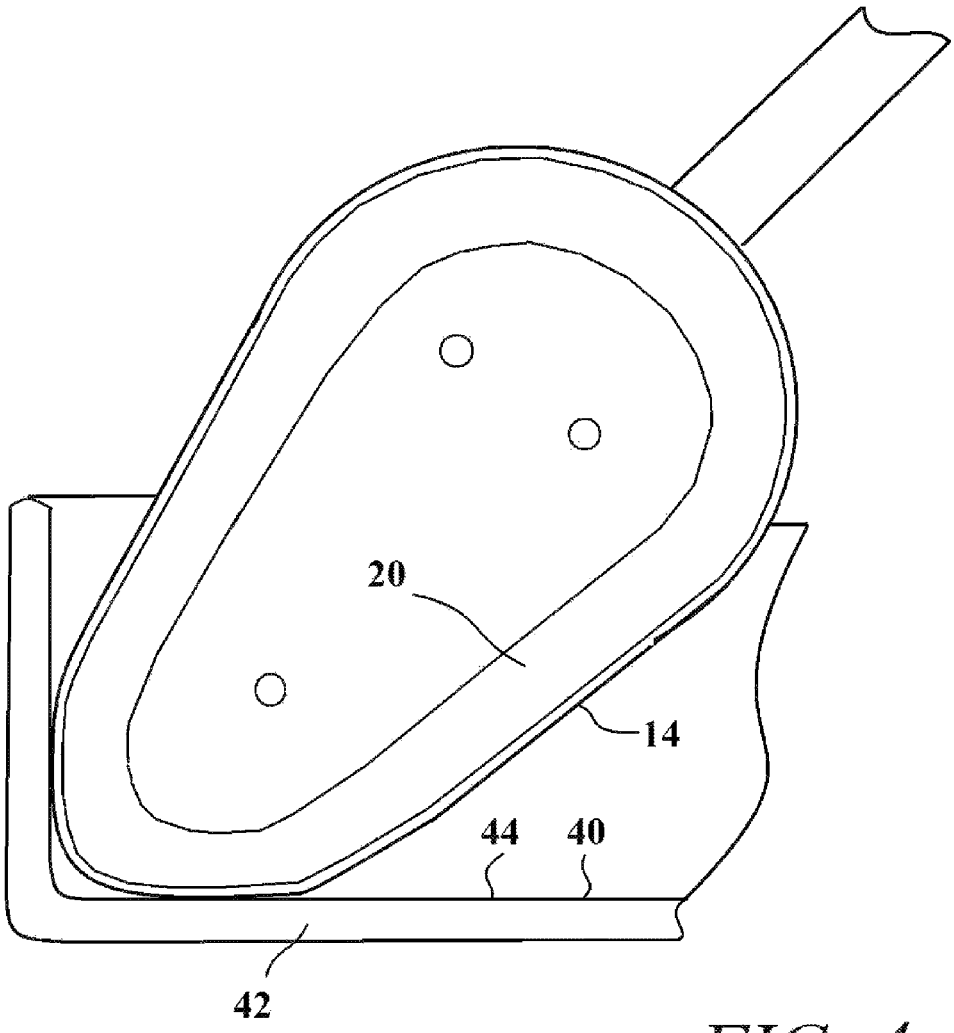
FIG. 4 is a side view of the exemplary embodiment of a cleaning device engaging the corner of a cooking pan coated with a non-stick surface.

Referring now to FIG. 3 in conjunction with FIG. 2, it will be understood that as the scrubber head 14 is pressed against a non-stick cooking surface 40, the beveled surface 26 flattens toward the cooking surface 40 and the pointed top edge 24 contacts the cooking surface 40. This creates a powerful scraping action that is capable of scraping most any food material 38 off the cooking surface 40. Furthermore, as can be seen in FIG. 4, due to the oblong shape of the scrubber head 14, the oblong scrubber head 14 can be forced into tight corners of a cooking pan 42. The flexible peripheral wall 20 of the scrubber head 14 is easily deformable under the pressure of a user's hand and can be forced into the corner shape of most pots and pans. In this way, any food stuck in a corner or curve of a cooking pan 42 can be scraped away using only one or two scraping motions. The less scraping motions that are used, the less wear is experienced by the non-stick coating 44 and the longer the non-stick coating 44 will last.

Figure 5:
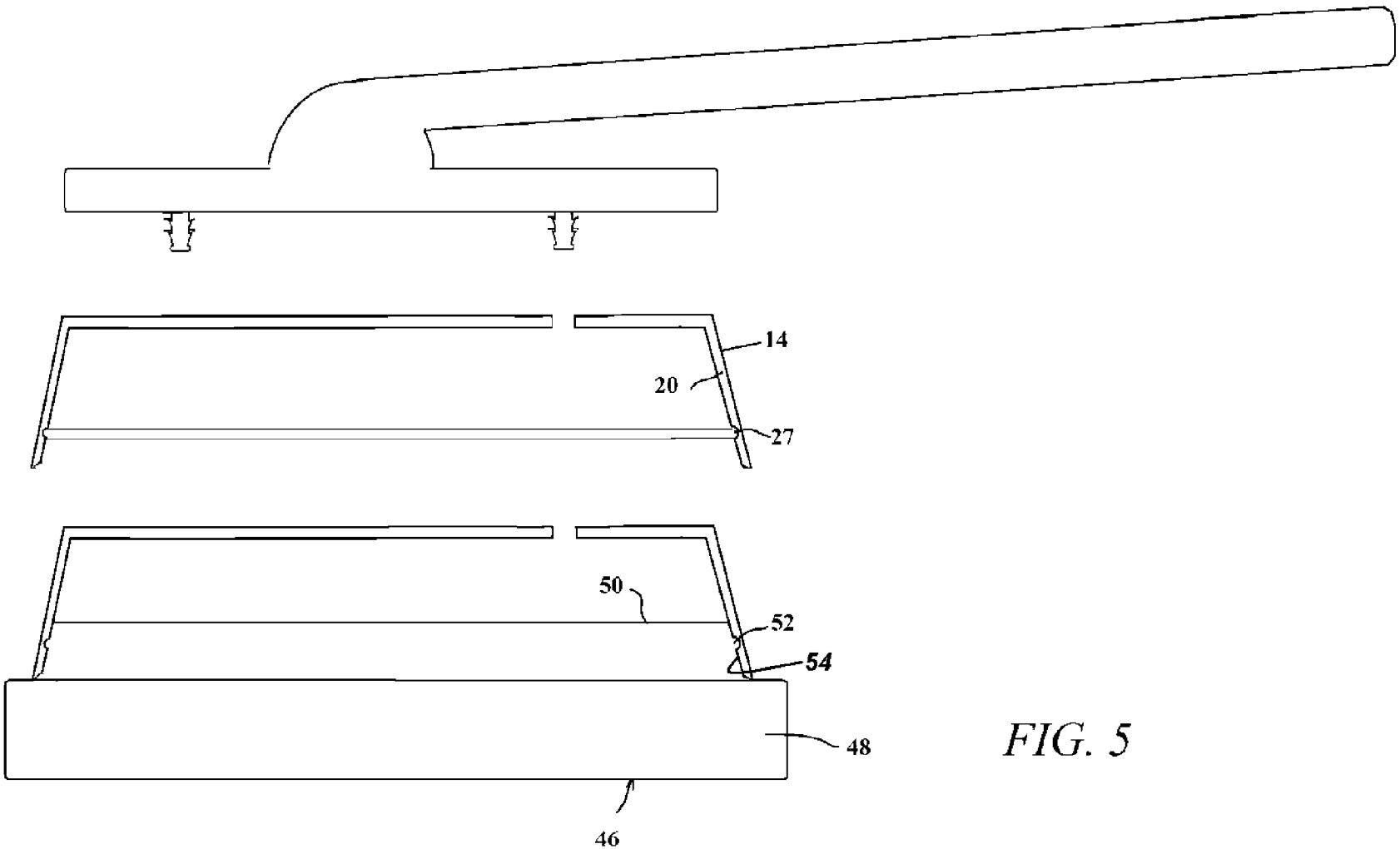
FIG. 5 is a cross-sectional view of the exemplary embodiment shown in conjunction with a detachable cleaning accessory.

Referring now to FIG. 5, it can be seen that a plurality of scrubber heads 14 can be stacked together in a space efficient manner. Accordingly, a plurality of scrubber heads 14 can be efficiently packaged together for sale. Furthermore, cleaning accessories 46 can be provided. The cleaning accessories 46 have an enlarged working surface 48, that can be made of sponge material or plastic wool. The enlarged working surface 48 is attached to a smaller base 50. The base 50 passes into the interior of the scrubber head 14. A protruding ring 52 is formed on the sidewall 54 of the base 50. The protruding ring 52 engages an optional locking groove 27 formed on the inside of the peripheral wall 20. Accordingly, the cleaning accessory 46 can be mechanically interconnected to the scrubber head 14. Once the components are interconnected, the resulting assembly can be used to wash non-stick surfaces or even ordinary dishes. If a dishwasher encounters material that has adhered to a non-stick surface, the dishwasher removes the cleaning accessory 46 and scrapes the material away using the scrubber head 14 in the manner previously described.

Figure 6:
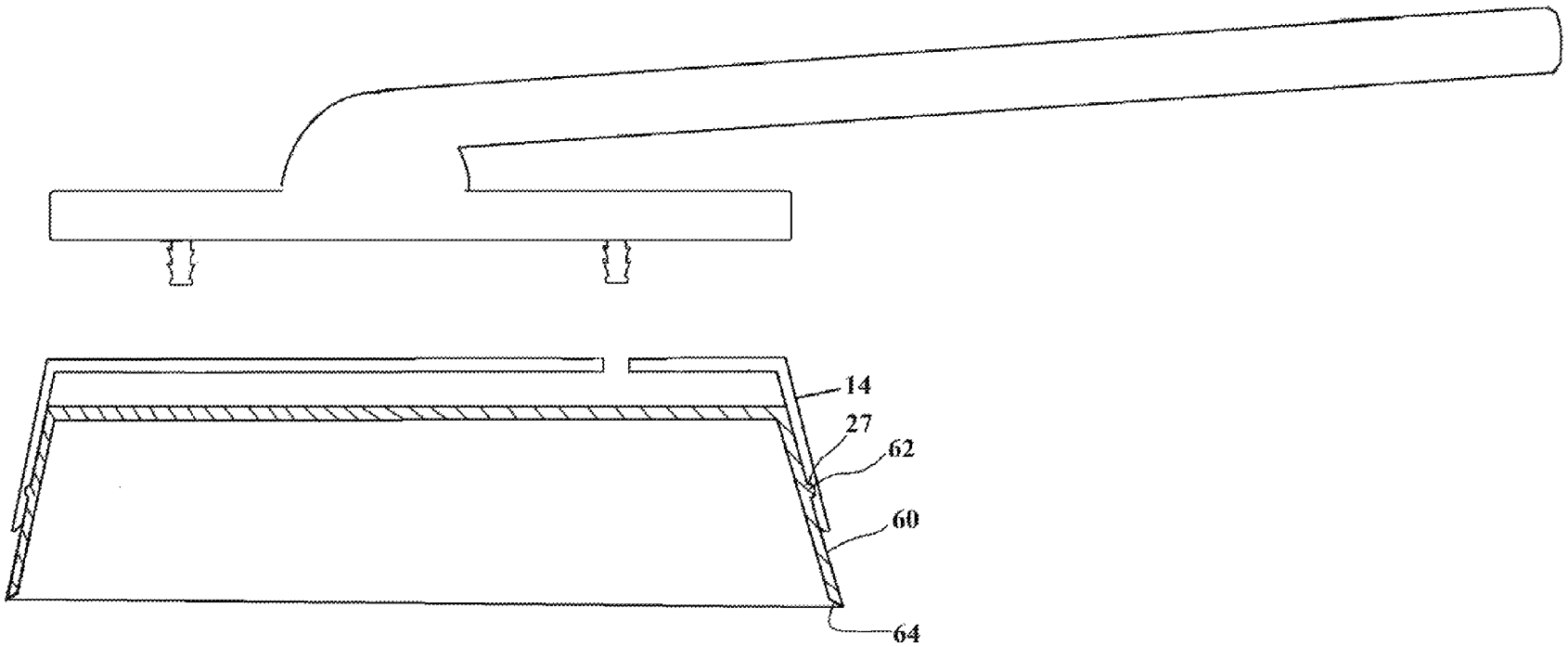
FIG. 6 is a cross-sectional view of the exemplary embodiment shown in conjunction with a detachable scraper head.

Although the present invention cleaning device 10 is primarily designed to lean non-stick cooking surfaces, it can also be used to clean metal surfaces that are not coated with non-stick material. To increase the cleaning power of the soft plastic scrubber head 14, a scraper attachment can be provided. Referring now to FIG. 6, it can be seen that a scraper attachment 60 has a shape that is the same as that of the scrubber head 14. In this manner, the scraper head 60 can set itself inside of the scrubber head 14. The scraper head 60 has a locking ring 62 that engages the groove 27 in the scrubber head 14, therein locking the scraper head 60 into place.

The scraper head 60 is stamped from a thin sheet of brushed aluminum alloy or stainless steal. The scraper head 60 also has a beveled edge 64. In this manner, the scraper head 60 can deform and scrape in the same manner as the soft plastic scrubber head 14. However, since the scraper head 60 is made of metal, it can scrape material from cast iron, stainless steel and other traditional cooking surfaces with far more efficiency than soft plastic.

It will be understood that the embodiment of the present invention that is illustrated and described is merely exemplary and that a person skilled in the art can make many variations to that embodiment. For instance, the shape of the scraper head and the shape of the handle unit can be varied in many ways. All such embodiments are intended to be included within the scope of the present invention as defined by the claims.

What is claimed is:

1. A cleaning implement for non-stick surfaces, comprising:

a handle unit;

a plastic scrubber head having a flat base with an oblong-shaped periphery and a continuous flexible peripheral wall that extends at least two centimeters from said periphery of said base, wherein said periphery follows a first radius of curvature at a first end and a smaller second radius of curvature at an opposite second end, and wherein said peripheral wall has a beveled top edge, and a plurality of mechanical fasteners that selectively connects said handle unit to said plastic scrubber head in a manner that enables said scrubber head to be selectively removed and replaced when worn.

2. The implement according to claim 1, wherein said handle unit includes a mounting plate and a handle affixed to said mounting plate.

3. The implement according to claim 2, wherein said mechanical fasteners selectively interconnect said base of said scrubber head to said mounting plate of said handle unit.

4. The implement according to claim 1, wherein said peripheral wall has a thickness of less than five millimeters.

5. The implement according to claim 1, wherein said peripheral wall extends from said base at a diverging angle.

6. The implement according to claim 1, wherein said scrubber head is integrally molded as a single piece from a plastic material selected from a group consisting of polyethylene terephthalate, high-density polyethylene or polypropylene.

7. The implement according to claim 1, wherein said peripheral wall defines a confined area and said peripheral wall includes a locking groove formed in a surface of said peripheral wall that faces said confined area.

8. The implement according to claim 7, further including an auxiliary cleaning head that attaches to said scrubber head and engages said locking groove.

9. A cleaning implement for non-stick surfaces, comprising:

a handle unit having a handle and a mounting plate;

mechanical fasteners extending from said mounting plate; and a plastic scrubber head having a base and a continuous flexible wall that extends from a periphery of said base, wherein said flexible wall defines a confined area and includes a locking groove formed in a surface of said peripheral wall that faces said confined area;

wherein mounting holes are formed through said base of said scrubber head that are engaged by said mechanical fasteners, therein selectively joining said base of said scrubber head to said mounting plate of said handle unit; and an auxiliary cleaning head that attaches to said scrubber head.

10. The cleaning implement according to claim 9, wherein said flexible wall has a beveled top edge and wherein said flexible wall extends at least two centimeters from said base.

11. The implement according to claim 9, wherein said flexible wall has a thickness of less than five millimeters.

12. The implement according to claim 9, wherein said periphery of said base has an oblong shape and said flexible wall extends along a path having said oblong shape.

13. The implement according to claim 9, wherein said flexible wall extends from said base at a diverging angle.

14. The implement according to claim 13, wherein said base is planar.

15. The implement according to claim 9, wherein said scrubber head is integrally molded as a single piece from a plastic material selected from a group consisting of polyethylene terephthalate, high-density polyethylene or polypropylene.

16. The implement according to claim 9, wherein said auxiliary cleaning head is formed of metal.

17. A cleaning implement for non-stick surfaces, comprising:

a handle unit;

a plastic scrubber head having a base and a continuous flexible peripheral wall that extends at least two centimeters from said base, wherein said peripheral wall has a beveled top edge, and wherein the peripheral wall defines a confined area and includes a locking groove formed in a surface of said peripheral wall that faces said confined area; and a plurality of mechanical fasteners that selectively connects said handle unit to said plastic scrubber head in a manner that enables said scrubber head to be selectively removed and replaced when worn.

* * * * *